US006332346B2

(12) United States Patent
Komiya et al.

(10) Patent No.: US 6,332,346 B2
(45) Date of Patent: Dec. 25, 2001

(54) METAL VESSEL AND A FABRICATION METHOD FOR THE SAME

(75) Inventors: Yasuhiko Komiya; Shoji Toida, both of Tokyo (JP)

(73) Assignee: Nippon Sanso Corporation, Tokyo (JP)

( * ) Notice: Subject to any disclaimer, the term of this patent is extended or adjusted under 35 U.S.C. 154(b) by 0 days.

(21) Appl. No.: 09/728,635

(22) Filed: Dec. 1, 2000

Related U.S. Application Data

(62) Division of application No. 09/236,546, filed on Jan. 26, 1999, now Pat. No. 6,182,487.

(30) Foreign Application Priority Data

Feb. 18, 1998 (JP) ..... 10-036434
Feb. 18, 1998 (JP) ..... 10-036435

(51) Int. Cl.[7] ..... B21D 26/02; B21D 39/08; B65D 8/04

(52) U.S. Cl. ..... 72/58; 72/61; 72/62; 29/421.1; 220/612

(58) Field of Search ..... 72/61, 58, 62; 220/612, 613; 29/421.1

(56) References Cited

U.S. PATENT DOCUMENTS 2,758,367 * 8/1956 Dougherty ..... 220/612
3,415,413 * 12/1968 Morley ..... 220/612
3,572,073 * 3/1971 Dean et al. ..... 59/62
3,594,894 * 7/1971 Mayer et al. ..... 220/612
4,892,214 * 1/1990 Hamaguchi et al. ..... 220/612
5,187,962 * 2/1993 Bilko et al. ..... 72/62
5,944,216 * 8/1999 Inaoka et al. ..... 220/612

FOREIGN PATENT DOCUMENTS

0465640 * 10/1952 (IT) ..... 220/612
96-14782 5/1996 (KR) .

OTHER PUBLICATIONS

Patent Abstract of Korea: Patent Application No. 96–14782, Fabrication Method For An Inner Cylinder of A Vacuum Thermal Insulation Bottle (in English).

* cited by examiner

*Primary Examiner*—David Jones
(74) *Attorney, Agent, or Firm*—Burns Doane Swecker & Mathis LLP

(57) ABSTRACT

In the present invention, in a method of fabricating a metal vessel formed by expanding in hydraulic bulge formation a cylinder having a bottom, wherein a flat plate material is formed into a cylinder, the edges welded, and a bottom member welded to one open part of the cylindrical shell member, the stationary point of the expanded part of the shell member is made the expanding part side from the shell member—bottom member weld of the cylinder with a bottom, and thereby by expanding the shell part on the opening side, a metal vessel is formed, and thus the time of the processing itself of a plurality of expanding process of press-working and ironing and transiting of moving from one step to the next can be completed by one step, decreasing the time and reducing the cost.

20 Claims, 13 Drawing Sheets

METAL VESSEL AND A FABRICATION METHOD FOR THE SAME

This application is a divisional of Application Ser. No. 09/236.546, filed Jan. 26, 1999, now U.S. Pat. No. 6,182, 487.

BACKGROUND OF THE INVENTION

1. Field of the Invention

The present invention relates to a metal vessels used, for example, used as an ice box, a thermos bottle, vacuum thermos cookware, heat-retaining electrical pot, and heat-retaining tank, and a method for fabrication of the same.

This application is based on patent application Nos. Hei 10-36434 and Hei 10-36435, filed in Japan, the content of which is incorporated herein by reference.

2. Description of Related Art

Conventionally, metal tubular vessels having a bottom are fabricated. These vessels are, for example, double-layered vessels comprising an integral inner vessel and outer vessel made using stainless steel, etc., or double-walled vacuum metal vessels having an inner and outer vessel with a vacuum therebetween providing superior heat-retention, or double-walled metal vessels with air maintained between the inner and outer vessels. In addition, these are used as vessels having a simple single layer metal, such as for flasks and table pots.

An example one such conventional metal Vessel has an opening on the upper part, and comprises a shell member with a diameter larger than the diameter of the opening part, and a bottom member. A specific example is the metal vessel 101A, as shown in FIG. 15, wherein a bottom member 103 has an external diameter approximately the same as the shell member 102 and formed in a vessel shape with a bottom being abutted to the shell member 102, welded, and made integral.

In addition, as shown in FIG. 17, another example is the metal vessel 101C, wherein a bottom member 105 has an external diameter approximately the same as inner diameter of the shell member 102, has the shape of an inverted dish which protrudes inward into the vessel, is inserted into the shell member 102, and whose end surface is welded and made integral with the end surface of the shell member 102. Furthermore, as shown in FIG. 16, there is a metal vessel 101 B wherein the bottom member 104 having an external diameter almost the same as external diameter of the shell member 102 is abutted with the end surface of the shell member 102, welded, and made integral.

These metal vessels are conventionally manufactured in the following manner.

After stamping a flat metal plate into the desired shape, by rolling and welding the edges, a cylinder (straight tube) is formed with both ends opening at about the same diameter, and then after forming a truncated cone whose openings at either end have different diameters (a tapered tube), a shell member is formed by expanding and reducing a shell by pressing or spinning. Then, a cup-shape is formed from a flat plate by pressing, and a bottom member formed by cutting off the flange thereof is welded to this shell member, producing a metal vessel.

In addition, after stamping a metal flat plate into the desired shape, it is rolled, and formed into a cylinder by welding the edges, and then, in the same manner, after welding the bottom member formed into a cup-shape by pressing, etc., to the cylinder, a shell member is formed by reducing the shell by spinning, etc., producing a metal vessel.

Furthermore, a different method for fabricating metal vessels is disclosed in Japanese Patent Application, Second Publication, No. Hei 7-41007. Therein, after they are welded and made integral, a shell member and the bottom member are expanded by a hydraulic bulge processing. If a radially expanding method using hydraulic bulge is used, a metal vessel having a widthwise cross-sectional shape other than a cylindrical shape, such as an elliptical shape or polygonal shape, can be obtained.

However, in the fabrication of metal vessels using conventional pressing and spinning, as a whole, much time is consumed because generally multiple expanding steps by the pressing and ironing of the rollers is carried out, as the processing time passes making cross-over time for transiting from one step to another is necessary.

In addition, in these processes the widthwise cross-sectional shape of the product is limited to a round shape because welding is difficult if the widthwise cross-sectional shape is not cylindrical. Furthermore, in order to make local deformations, there is the problem that defects such as fractures are produced during the formation. In addition, because of thinning of the formed parts, there is the problem that the strength of endurance when dropped, etc., is weakened.

Furthermore, when a metal vessel fabricated in this manner is to be used as the inner vessel of a double-layered vacuum vessel and metal plating is applied to the outer surface of the shell, there is the possibility of deterioration of the adhesion of the plating due to this unevenness, and thus fine unevenness and formation defects may be produced on the surface of steel processed by spinning and pressing.

In addition, the fabrication method using hydraulic bulge processing has the advantages of decreasing the number of steps in comparison to pressing and spinning, and decreasing the amount of processing time. However, because a deforming force is also used at the welded part, fractures may be produced in the welded part, and the product yield is lowered. For example, the shear force at the welded part when the total circumference of the shell member-bottom member is increased during the expansion of the welded part. In addition, in order to decrease the production of fractures, it is necessary to carry out pressure filling slowly. This decreases the speed of the expansion, which makes it impossible to carry out the hydraulic bulge process in the originally desired time, and further makes it impossible to sufficiently exhibit the characteristics of hydraulic bulge processing.

In addition, among the conventional metal vessels shown in the above-mentioned FIG. 15~FIG. 17, in the metal vessel 101A having the structure shown in FIG. 15, a mis-aligning in the welding between the shell member 102 and the bottom member 103 is easily produced, causing a deterioration in appearance. In addition, when the plate of both members is thin, there is a concern that defective welds will be produced. Furthermore, there are the problems that it soils easily because the surface of the welded part 106 is not smooth, and it is difficult to clean with a sponge or scrubbing brush because the inner diameter of the welded part is larger than the diameter of the opening.

In addition, when fabricating the vessel, there was no freedom in the shape because it is necessary to press down with a jig, etc., during welding, and because the shape of the shell is round and requires a straight part. Additionally, because the bottom member 103 is weak, there are the problems that it dents easily, and it is unstable when placed on a flat surface.

In addition, because the metal vessel 101B having the structure shown in FIG. 16 produces a gap in the welded part 106 in the interior of the vessel, there are the problems that it is easy for soilage to accumulate, and it is difficult to wash. Because of this, there is the concern that the soilage in the gap may decay, and thus these are not suitable in particular as food containers. In addition, crevice corrosion may be produced in the welded part 106, and thus these are not suitable for containing highly corrosive substances.

Furthermore, if the shell member 102 of the metal vessel 101C having the structure shown in FIG. 17 is not cylindrical, welding is very troublesome, and thus the shape of the shell member 102 cannot be selected freely. In addition, the bottom member 105 is weak, and when a solid substance such as ice is dropped into the opening, it can be easily deformed and dented.

Furthermore, because the inner diameter of the welded part is larger than the opening, there is the problem that the accumulated soilage in the welded part 106 cannot easily be cleaned with a sponge or scrubbing brush.

SUMMARY OF THE INVENTION

It is an object of the present invention to provide a method wherein, in the fabrication of a metal vessel, a process characterized as being a hydraulic bulge process can easily be realized, and can decrease the overall processing time of the metal vessel having a non-cylindrical widthwise cross-section, which is a present problem.

In addition, it is an object of the present invention to provide a metal vessel which can be fabricated by a method which can reduce this processing time in this manner, wherein the welding of shell member and the bottom member is simple and the appearance of the welded part is good, soilage cannot easily accumulate and it is easy to wash, and it has a high degree of freedom in its formation.

The present invention is fabrication method for a metal vessel wherein a tube with a bottom, having an opening part at one end of a shell member and the other end of this shell member made integral to the bottom member, it subject to hydraulic bulge formation, and forming a shell part having a diameter larger than the opening part, and characterized in: the hydraulic bulge formation being carried out so that the length of the weld between the shell member and the bottom member is approximately the same before and after the hydraulic bulge formation.

In a fabrication method for a metal vessel, a flat material is formed into a cylinder, and a metal vessel is fabricated by using hydraulic bulge processing which expands the cylinder having a bottom, wherein a bottom member is welded to an opening on one end of a cylindrical shell member by welding the edges. Because the stationary point of the expanding part of the shell member is made the expanded part side from the shell member—bottom member weld of the cylinder having a bottom, and the shell part of the opening side is enlarged more than this, it is possible to complete in one process the processing time of the transit time for moving from one step to the next step. In addition, because the time of the processing by multiple expanded tube steps by pressing and ironing processes can be reduced, the process time and the cost can be decreased.

In addition, because the entire length of the welded part between the shell member and the bottom member is almost unchanged during the expanding of the tube by the hydraulic bulge process, excessive force is not applied to the welded part, and there is no concern for fractures. In addition, because the welded surface of the shell member and the bottom member is made a shape for which the conditions of welding for a cylinder, etc., can be easily set, and thus can be easily and reliably welded, and subsequently, a shell part of the vessel in the hydraulic bulge processing can be formed to the desired cross-sectional shape, the cross-section shape to be finally obtained is not limited to a cylinder, and a vessel with many kinds of shapes, such as a polygon or an ellipse, can be easily fabricated.

Furthermore, because the vessel shell is formed by an expanding formation of the metal cylinder, it is possible to make the outer diameter of the cylinder of the unprocessed tube small, and in addition, because it is possible to carry out the formation of the blank using a rectangle, the material yield is very high, and it is possible to minimize the loss of steel, and thus possible to reduce the cost.

In addition, the metal vessel fabricated by the present fabrication process has a surface roughness of 1.0 $\mu$m or less. Therefore, when plating the external surface of the inner vessel of a double wall vacuum vessel, the adhesion of the plating is good because the surface roughness of this metal vessel is extremely small and the smoothness is average for the material, and thus it is possible to obtain a high quality product with a superior hear-retaining capability by using this metal vessel as the inner vessel of the double walled vacuum vessel.

Furthermore, by carrying out hydraulic bulge processing, this metal vessel is highly effective in preventing the accumulation of soilage even when the dish shaped bottom member has a convex shape facing the inside of the shell member because there is no production of a gap between the shell member and the bottom member. Furthermore, it is also easy wash.

In addition, the present invention is a metal vessel characterized in the metal vessel having an opening part at the upper part and comprising a shell member whose shell diameter is larger than the diameter of said opening part and a bottom member, and said shell member narrows at the bottom side and is jointed welding at an angle to a bottom member having an external diameter smaller than the shell diameter of said shell member and a shape projecting into the vessel (dish shape), and the welded part between the bottom member and the shell member is positioned at the deepest part of the vessel. Thereby, the following effects can be obtained.

The welded part does not stand out when the vessel is in place and the appearance is good because the welded part between the bottom member and the shell member matches the contour of the bottom member when viewed towards the bottom.

The strength of the bottom member is increased because the bottom member projects into the vessel, so even if a solid material such as ice dropped into the opening side, it is difficult to produce deformations or concavities.

Soilage accumulates on the vessel bottom only with difficulty because the shell member and the bottom member are joined at an angle.

Because the welded part is on the bottom surface of the vessel, and because it is smaller than the diameter of the shell member, it can be easily cleaned with, for example, a sponge.

The stability of the vessel on a flat surface is good because the welded part between the shell member and the bottom member is in the deepest part of the vessel, and thereby since the strength of the bottom is great, it is easy to handle not only in use but during the production processes, so few defects are produced by battering.

The freedom in shaping the shell member is great because the welded part is always round, irrespective of the shape the shell, and thus welding is easy.

DESCRIPTION OF THE PREFERRED EMBODIMENTS

Figure 1:
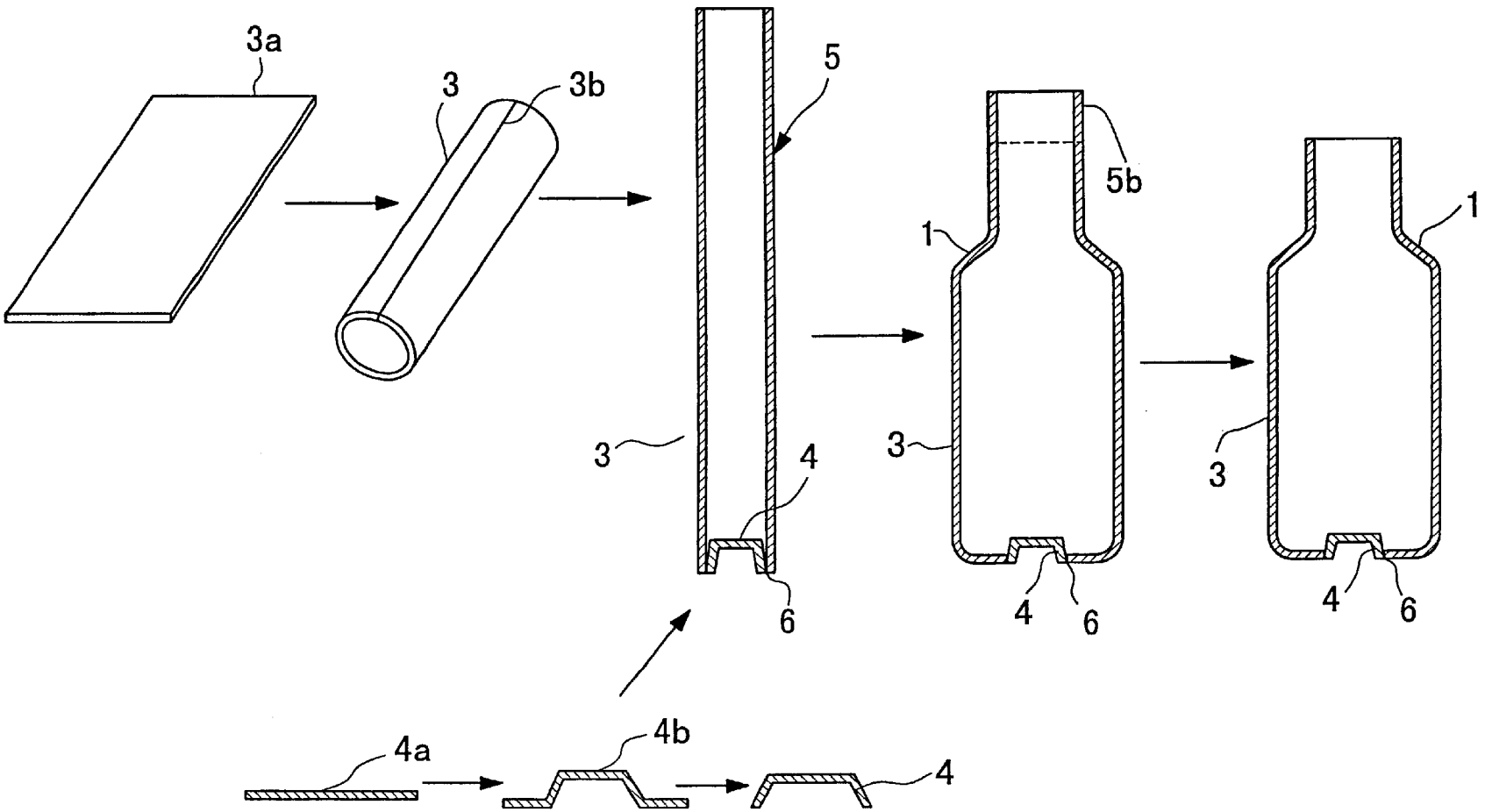
FIG. 1 is a process diagram showing the first example of the fabrication method of the metal vessel according to the present invention.

Below, a first embodiment of the fabrication method of the metal vessel of the present invention will be explained referring to FIG. 1 and FIG. 2.

In fabricating the metal vessel, first a blank die is used, and a rectangular flat plate 3*a* is stamped by pressing a stainless steel plate. Next, the rectangular flat plate 3*a* is rounded by rolling, its edges 3*b* are welded, and a cylindrical shell member 3 is formed. At the same time, in order to fabricate the bottom member, a stainless steel plate is pressed using a blank die, a round flat plate 4*a* is stamped, and next, by pressing, a round dish shaped member 4*b* having a flange is made. Further, a bottom member 4 is made by eliminating the excess flange of the member 4*b*. At this time, the external diameter dimension of the bottom member 4 is set so as to be almost equal to the inner diameter of the shell member 3, the bottom member 4 is inserted into one opening of the shell member 3 so that an open part(concave part) of the bottom member 4 faces the outside of the shell member 3 and the end of the bottom member 4 are aligned, and made integral by TIG welding, forming a cylinder 5 with a bottom.

Next, in order to expand the shell part of the cylinder 5 with a bottom, hydraulic bulge forming is carried out. The die 30 of this hydraulic bulge forming, as shown in FIG. 2, is provided with a moving die 32 which can move vertically and which protrusion forms a convex part 33 which engages the bottom member 4 of the cylinder 5 with a bottom facing the inside of the die, and a stationary die 31 having packing 34 which engages the opening of the cylinder 5 with a bottom, and furnished with a liquid injection passage 35 in an airtight manner on the side facing the convex part 33. This liquid injection passage 35 is connected to a liquid supply apparatus not shown, and a liquid such as water can be supplied to the inside of the cylinder 5 with a bottom mounted in the die 30. When the cylinder 5 with a bottom is disposed in the die 30, the convex part 33 is used to position the cylinder 5 with a bottom correctly in the die 30. Additionally, the welded part 6 between the shell member 3 and the bottom member 4 is disposed such that it is at the stationary point position of the convex part 33 of the die 30. In addition, the die 30 has the desired expansion dimensions from the shell to the bottom.

Figure 2:
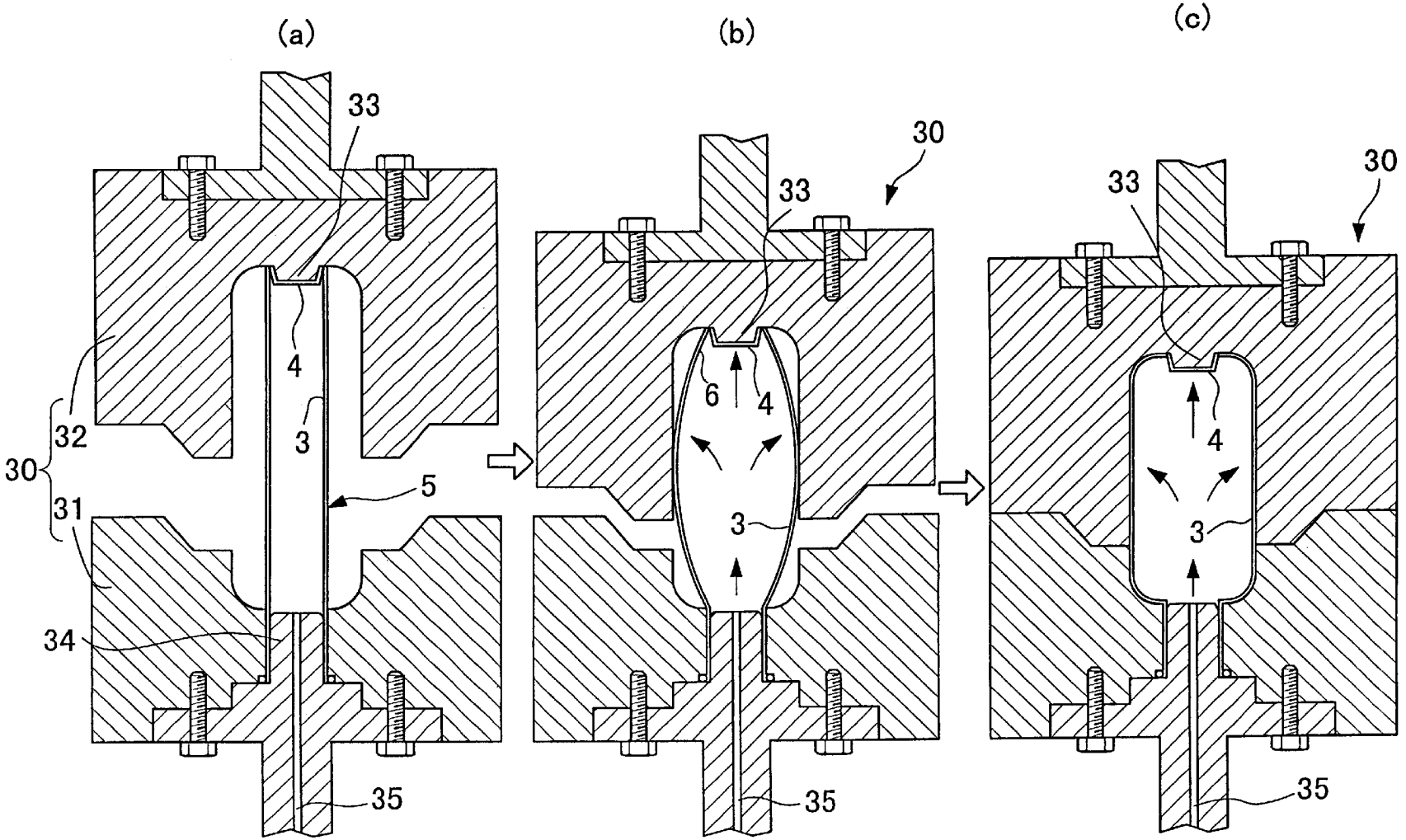
FIG. 2(*a*)~FIG. 2(*c*) is a cross-section showing the hydraulic bulge forming in the same first example.

The packing 34 of the stationary die 31 of this die 30 is engaged with the opening of the cylinder 5 with a bottom (FIG. 2(*a*)), and the moving die 32 is moved towards the stationary die 31. At the same time, water incorporating a rust preventing oil is injected into the cylinder 5 having a bottom from the liquid injection passage 35 provided in the stationary die 31, and by applying pressure, the shell member 3 is expanded into the expansion space in the die 30 (FIG. 2(*b*)). At this time, because the shell member 3 expands with the stationary point being the welded part 6 (the welded part between the shell member and the bottom member) or the raised part of the bottom of the bottom member 4 and the bending point, during the expansion of the tube, on this welded part 6, there is almost no force acting so as to expand the circumferential length thereof Because of this, almost no excessive force is applied to the welded part 6 between the shell member 3 and the bottom member 4, and it is possible to maintain completely the shape of the bottom member had after welding, the thickness of the expanded shell member 3 is not locally thinned, no fractures are produced, and expansion is possible in a short time (FIG. 2(*c*)). After expansion, the moving die 32 is raised, and after water in the vessel is drained, the vessel is removed.

The expansion step can be carried out in a short time, and furthermore, there are few transits between each step, and the operation can progress with very high efficiency. Subsequently, the metal vessel 1 is obtained by cutting the opening 5*b* of the vessel to a specified length.

The shell part of the fabricated metal vessel 1 as a whole is evenly expanded, and the shell part thickness is not locally thinned. In addition, in comparison to a vessel formed by pressing and spinning, the outer surface of the shell part expanded by hydraulic bulge forming produces few irregularities and formation defects, and in particular, in comparison to spinning the finish is far more smooth, and the average surface roughness is 1.0 $\mu$m or less, and preferably, it is possible to form a surface roughness equivalent to that of the raw material (about 0.20 $\mu$m). In addition, when this metal vessel 1 is used as the inner vessel of a double walled vacuum vessel, and the outer surface is plated, because the surface is smoothly finished, the adhesion of the plating is good.

In this fabrication process, by making the initial shape of the blank of the shell member 3 roughly a rectangle, the product yield is very good, decreasing the loss of the steel material is possible, and the fabrication cost can be reduced due to the reduction in material cost.

Figure 3:
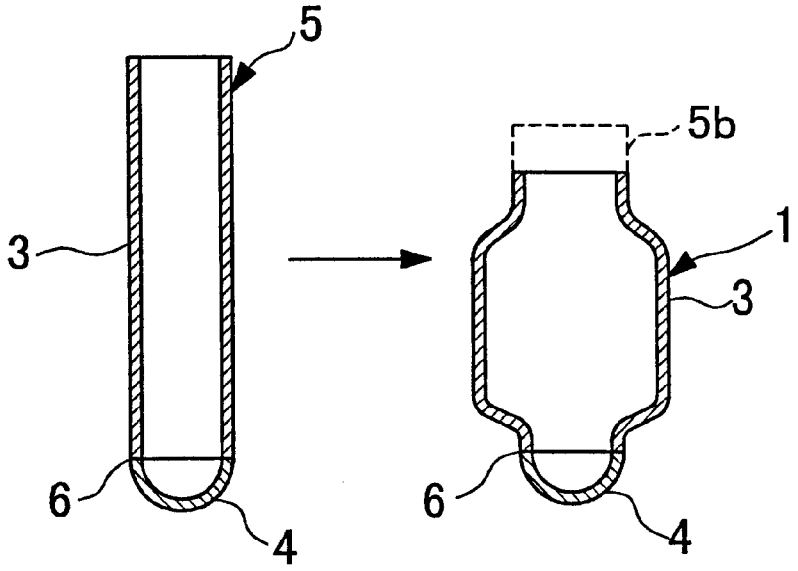
FIG. 3 is a cross-section showing an example of an altered shape of the first example.

In the present embodiment, the bottom member 4 is inserted so that an open part of the bottom member faces the outside of the shell member 3, and welding is carried out, but the engagement direction of the bottom member 4 is not limited in this manner. As show in FIG. 3, by making the open part of the bottom member 4 faces the inside of the shell member 3 and welding, and making the expanding stationary part of the hydraulic bulge die 30 on the opening part side more than said weld 6, it is possible to position it so as not to include the weld part 6 between the shell member 3 and the bottom member 4. As a result, in the same way applying excessive force of the welded part 6 during the hydraulic bulge formation is prevented, fractures are not produced at all, and the fabrication time is shortened.

Figure 4:
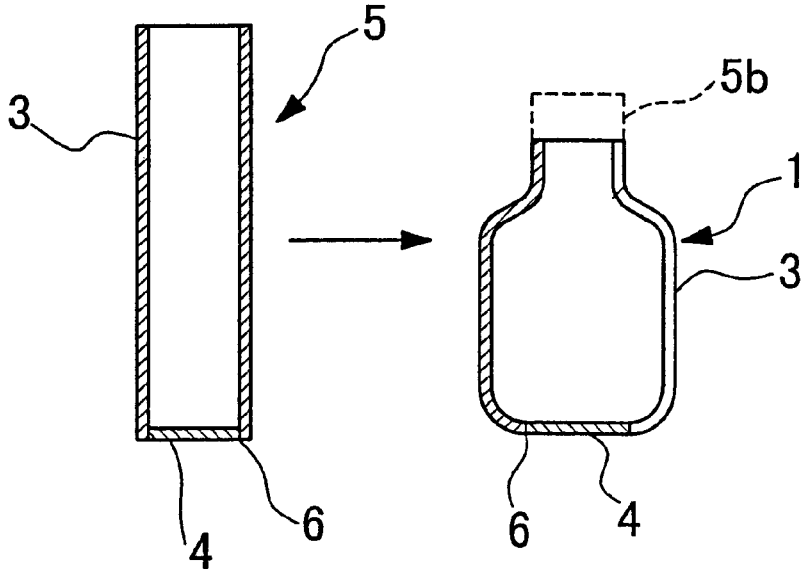
FIG. 4 is a cross-section showing another example of an altered shape of the first example.
Figure 5:
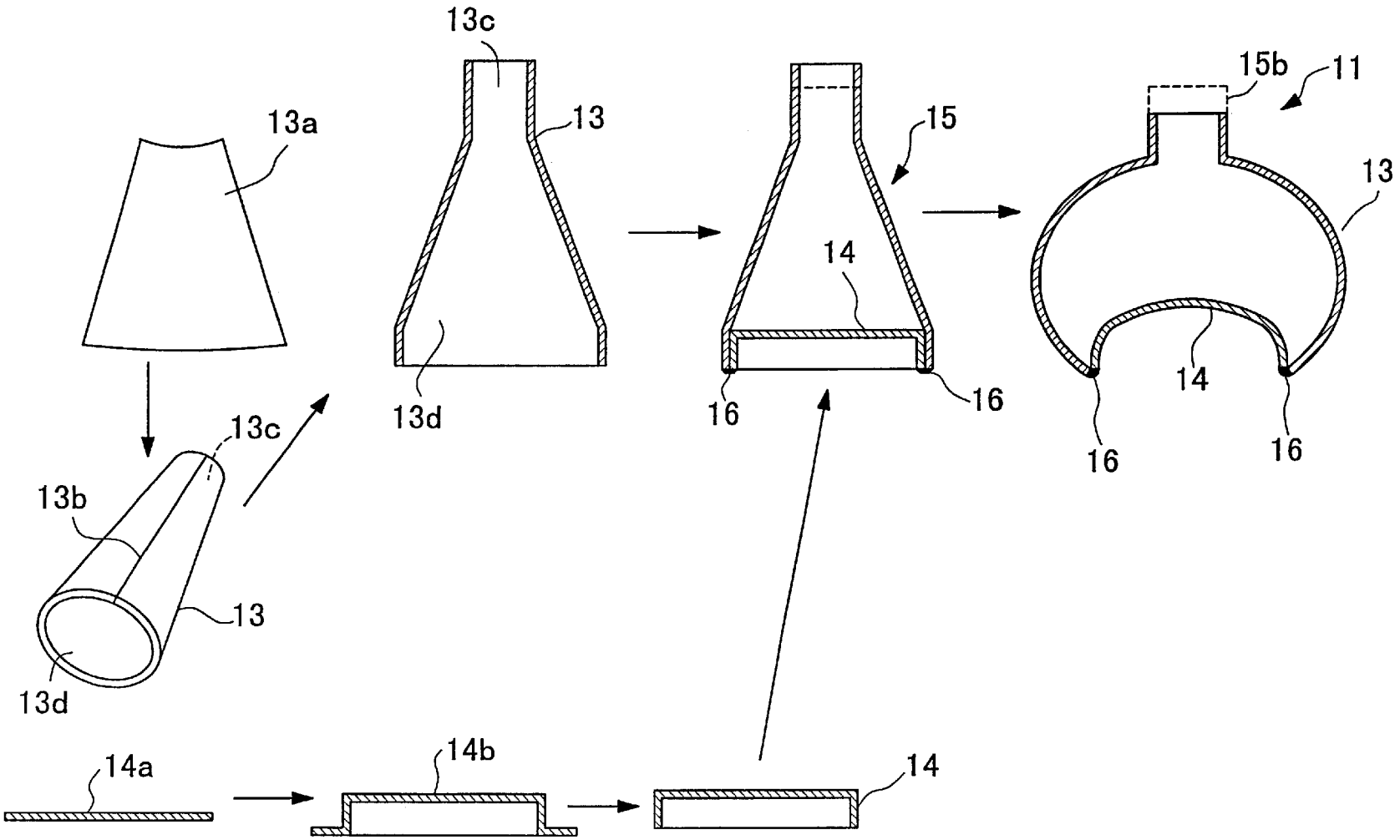
FIG. 5 is a process diagram showing a second example of the fabrication method of the metal vessel according to the present invention.

Furthermore, as shown in FIG. 4, by leaving the shape of the bottom member 4 a flat plate, welding it to the edge of the shell member 3, and setting the bottom member 4 of the cylinder 5 with a bottom so as to contact the bottom surface of the hydraulic bulge die 30, the stationary part of the expansion is made the welded part 6, and it is possible to expand the shell member 3 of the opening side of the cylinder 5 with a bottom more than the welded part 6. By this method, during the hydraulic bulge process, almost no force is applied to expand the circumferential length of the welded part 6, no fractures are produced, and it is possible to shorted the fabrication time.

A Second embodiment of the fabrication method of the metal vessel of the present invention will be explained referring to FIG., 5 and FIG. 6.

First, in fabricating the metal vessel, for example, a blank die is used, stainless steel plate pressed, and a flat plate 13*a* with a roughly fan shape with the peak cut off is stamped. Next, this flat plate 13*a* is rounded by rolling, and by welding the edge 13*b*, a shell member 13 with a truncated cone shape is made. Further, both edges of the opening parts 13*c*, 13*d* are formed almost perpendicularly.

Again in the same manner, a blank die is used, a stainless steel plate pressed, and a round flat plate 14*a* is stamped. Then, pressing is carried out and a round dish shaped member 14*b* with a flange is produced. Next, the flange part of the round dish shaped member 14*b* is eliminated, and the bottom member 14 is formed. At this time, the dimension of the outer diameter of the bottom member 14 is set almost equal to the inner diameter of the opening part 13*d* of the shell member. In addition, the open part (concave part) of the bottom member 14 is disposed facing the outside of the shell member 13, inserted into the opening part 13*d*, the opening part 13*d* of the shell member 13 and the end of the bottom member 14 are aligned, made integral by TIG welding, and a conic shaped cylinder 15 with a bottom is made.

Next, in order to expand the shell member 13 of the cylinder 15 with a bottom, hydraulic bulge forming is carried out. As shown in FIG. 6, this hydraulic bulge die 30 provides a moving die 32 in which the convex part 33 engaging the bottom member 14 of the cylinder 15 having a bottom is protrusion formed towards the inside of the die, and is provided so as to be able to move vertically, and a stationary die 31 having packing 34 which engages air-tight the opening of the tube 15 with a bottom and provided with a liquid injection passage 35 on the side facing to the convex part 33. This liquid injection passage 35 is connected to a liquid supply apparatus not shown, and such that a liquid such as water can be supplied to the inside of the cylinder 15 with a bottom positioned in the die 30. When the cylinder 15 with a bottom is disposed inside the die 30, the convex part 33 can be used in order to position the cylinder 15 with a bottom correctly in the die 30. In addition, the welded part 16 between the shell member 13 and the bottom member 14 is disposed so as to be at the stationary point position of the convex part 33 of the die 30. In addition, the shell of the die 30 spreads in the shape of a dome.

Figure 6:
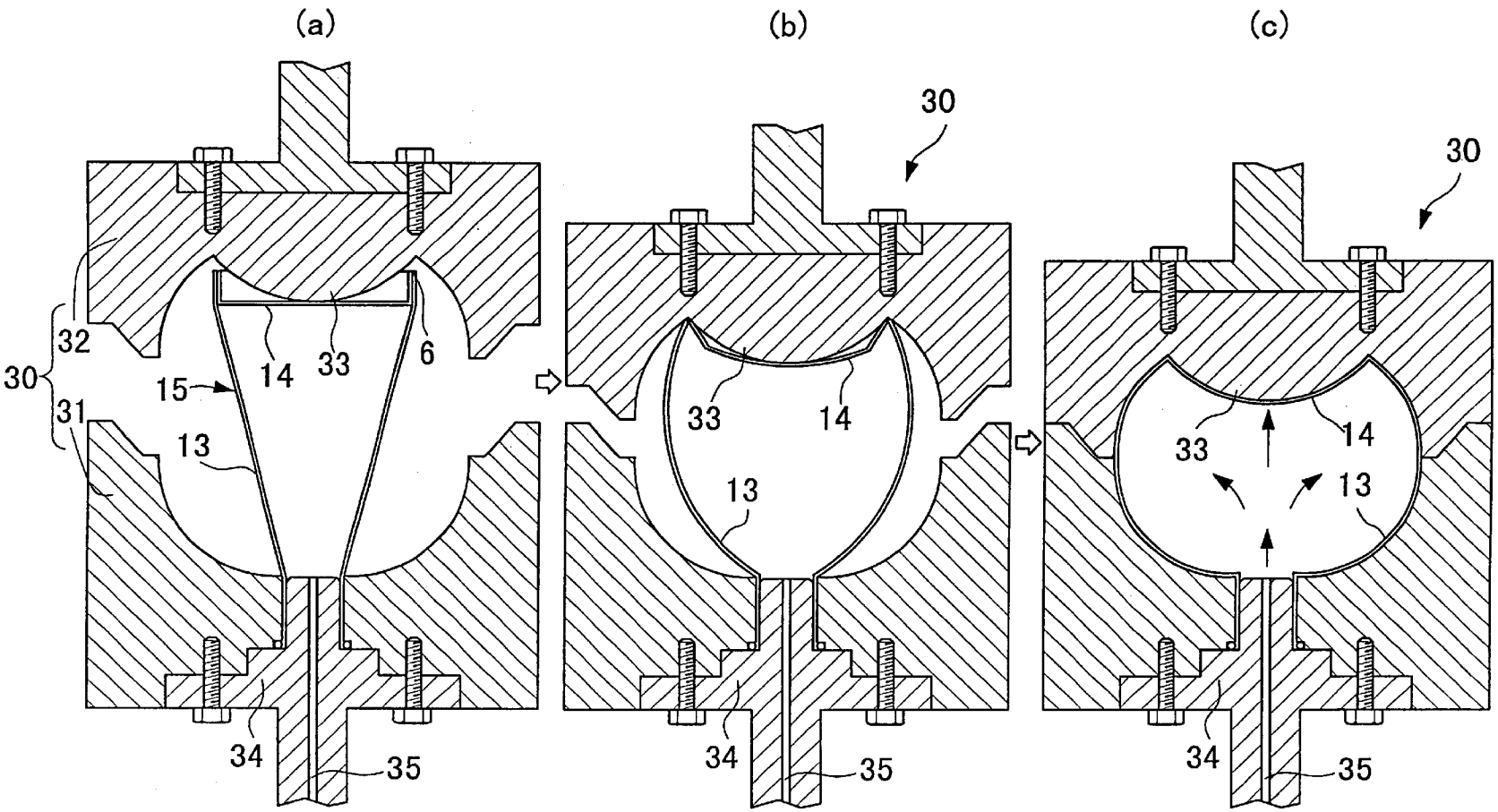
FIG. 6(*a*)~FIG. 6(*c*) is a cross-section showing the hydraulic bulge forming in the same second example.

The opening of the cylinder 15 with a bottom is engaged in the packing 34 of the stationary die 31 of the die 30 (FIG. 6(*a*)), and the moving die 32 is moved toward the direction of the stationary die 31, and at the same time, water which includes a rust preventing oil is injected into the cylinder 15 with a bottom from a liquid injection passage 35 provided in the stationary die 31, pressure is applied, and the shell member 13 is expanded into the expansion space in the die 30 (FIG. 6(*b*)). At this time, because the shell member 13 expands with the stationary point being the welded part 16 (the welded part between the shell member and the bottom member) and the bottom surface of the bottom member 14, during the expansion of the tube, almost no force is applied to the welded part 16 which increases the circumferential length thereof. Because of this, almost no excessive force is applied to the welded part 16 between the shell member 13 and the bottom member 14, it is possible to maintain the shape of the bottom member during the welding, the thickness of the expanded shell member 13 has no local thinning, no fractures are produced, and it is possible to carry out the expansion in a short time (FIG. 6(*c*)). After the expansion, the moving die 32 is raised, the water in the vessel is drained, and the vessel removed.

This expansion step can be carried out in a short period of time, and furthermore, there are few transitions between steps, and the operation proceeds with high efficiency. Subsequently, the metal vessel 11 is obtained by cutting the opening 15*b* to a specified length.

A third embodiment of the fabrication method of the metal vessel of the present invention will be explained referring to FIG. 7.

First, in fabricating the metal vessel, for example, a blank die is used, stainless steel plate pressed, and a flat plate 23*a* with a rectangular shape is stamped. Next, the flat plate 23*a* is rounded by rolling, and by welding the edges 23*b*, a cylindrical shell member 23' is made. Subsequently, a flange 23*c* is formed by bending the bottom of the shell member 23' 90° inside the cylinder, and a shell member 23 having a partial bottom with one part open is made.

At the same time, in order to fabricate the bottom member 24, a circular flat plate is stamped by pressing from a stainless steel plate using a blank die. At this time, the dimension of the outer diameter of the bottom member 24 a dimension which allows sealing the bottom open part of the shell member 23, and the perimeter of the edge of the bottom member 24 is made integral with the flange part 23*c* of the bottom of the shell member 23 by TIG welding, thereby making the cylinder 25 with a bottom.

Next, in order to expand this shell part of the cylinder 25 with a bottom, hydraulic bulge forming is carried out. The die of this hydraulic bulge forming is the same as that in the previous first embodiment. The cylinder 25 with a bottom is set so as to be mounted in the die 30, and the stationary point of the expansion of the cylinder 25 with a bottom can be made the bending part of the shell part and bottom part. In the same manner as each of the previous embodiments, by carrying out hydraulic bulge formation, almost no excessive force is applied to the welded part 26, there is no local thinning of the thickness of the expanded shell part, no fractures are produced, and the expansion can be carried out in a short time.

Figure 7:
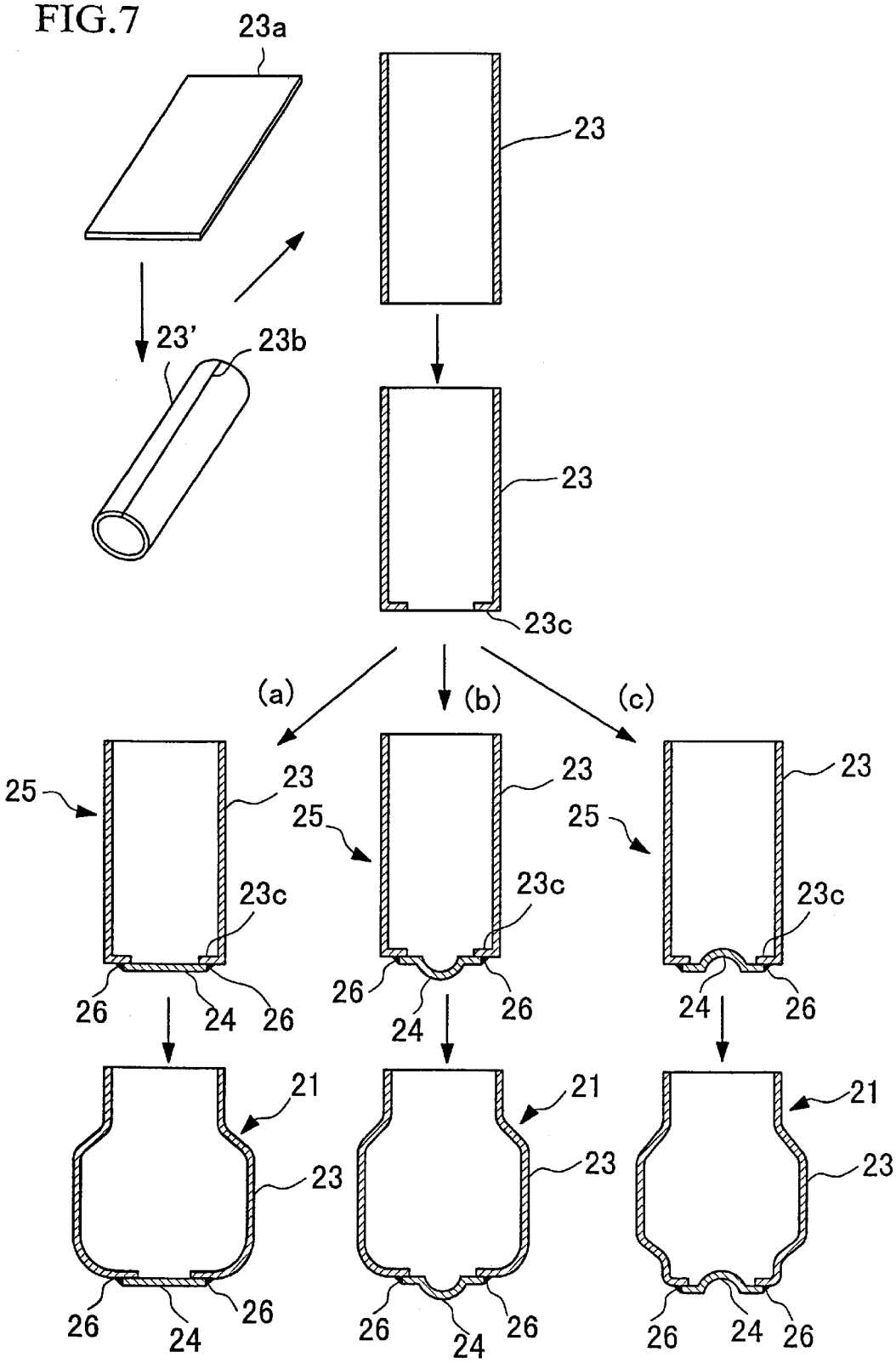
FIG. 7 is a process diagram showing a third example of the fabrication method of the metal vessel according to the present invention.

In the embodiment shown in (a) in FIG. 7, the flat plate is welded to the bottom member 24 as is, but the welding method for the bottom member 24 is not limited to this. For example, as shown in (b) in FIG. 7, the open part of the round dish shaped bottom member 24 is disposed towards the inside of the shell member 23, welded to a flange part, and by the expanded part of the hydraulic bulge die is made outside the welded part 26, during the hydraulic bulge forming, the same effects as the previous cases can be obtained, such as preventing the application of excessive force to the welded part 26, producing no fractures, and carrying out the processing in a short time.

Furthermore, as shown in (c) in FIG. 7, by setting the open part of the bottom member 24 in the outward direction of the shell member 23, the opposite direction of that in (b) in FIG. 7, welding it to the flange, and making the expanding part of the die of the hydraulic bulge outside this welded part 26, like the previous example, the effects are obtained that during the hydraulic bulge processing, application of excessive force on the welded part 26 is prevented, no fractures are produced, and it is possible to shorted the fabrication time.

Moreover, in each of the above-described embodiments, the shell shape was disclosed for a cylindrical shaped metal vessel, but the fabrication method of the metal vessel of the present invention is not limited to this, and it is possible to produce vessels whose shell widthwise cross-section is an ellipse, a polygonal shape like a square, etc.

In this case, simple fabrication is possible by changing the shape of the die of the hydraulic bulge process to the desired shape. Furthermore, the shape of the welded part between the bottom member and the shell member is not limited to a circular shape, the welded part can weld of a polygonal bottom member and shell member, and carrying out hydraulic bulge forming making this welded part the stationary point, almost no force which expands the welded part in the lengthwise direction is applied, and the desired shape can be obtained.

Furthermore, for a simpler production, it is preferable that the shape of the welded part between the bottom member and shell member be circular. In this case, because the weld between the bottom member and the shell member is complete with a circular weld, the welding conditions such as the angle between the torch and the welded part, the welding speed, and the amount of heat input can be easily set, and the control of the welding is very easy.

Figure 8:
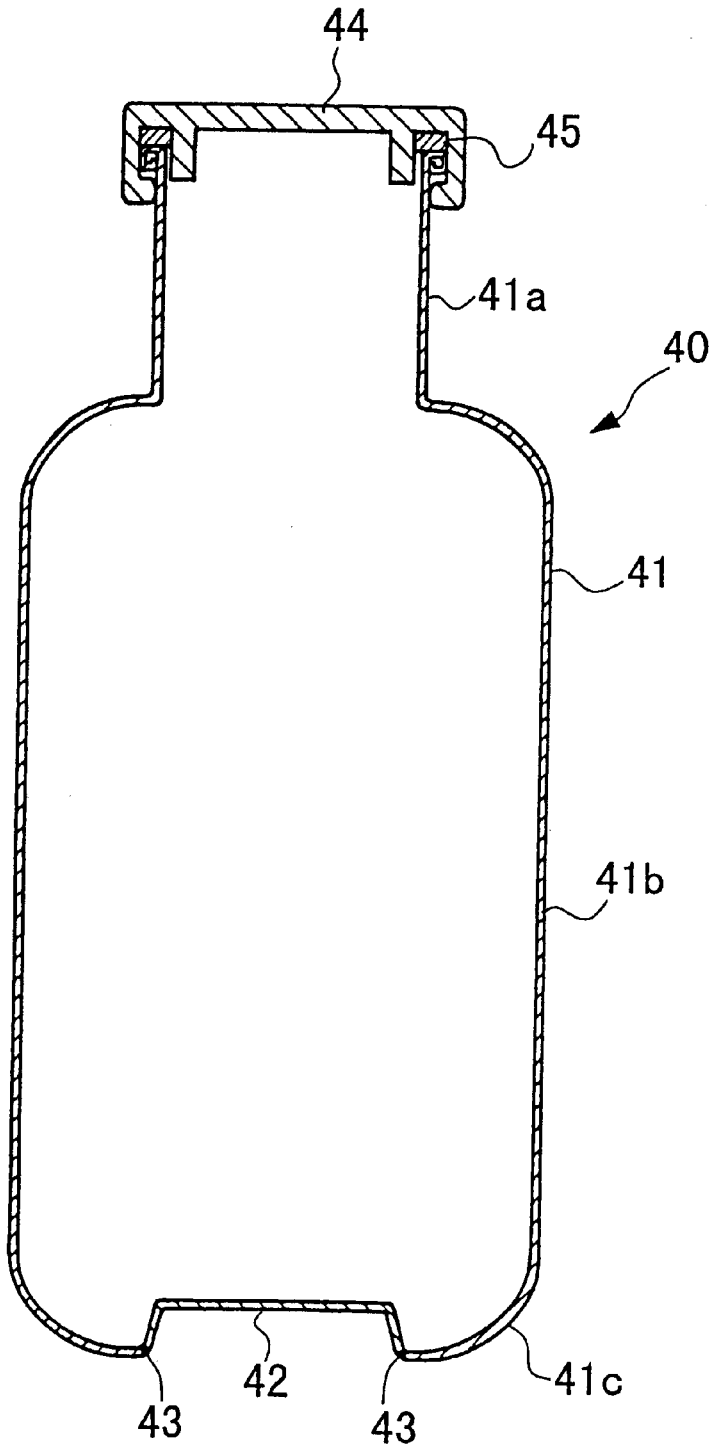
FIG. 8 is a lengthwise cross-section showing shape of the metal vessel of the present invention.

FIG. 8 is an example of a metal vessel obtained by the above-described fabrication method for a metal vessel of the present invention, and shows a one-layer metal vessel. This metal vessel 40 has an cylindrical open part 41*a* at the top, and comprises a cylindrical shell part 41*b* with a diameter larger than the opening part 41*a*, a shell member 41 wherein the its lower part has a reduced diameter part 41*c* which extends towards the inward radial direction, and a circular inverted dish shaped bottom member 42 projecting into the vessel.

This bottom member 42 is engaged on the edge of the reduced diameter part 41*c* of the shell member 41 by welding at an angle. This contact angle is approximately 90° in the present example. The welded part 43 between the bottom member 42 and the shell member 41 is positioned at the deepest part of the vessel 40.

The upper edge of the open part 41*a* is curled to the outside, and on the edge a synthetic resin cap 44 is engaged in a freely attachable and detachable manner. On the inner surface of this cap 44, a packing 45, such as a rubber 'o' ring is provided. Then, by engaging the cap 44 in the open part 41*a*, the packing 45 presses against the upper edge of the open part 41*a*, and the sealing of a liquid is maintained. Moreover, this cap 44 is not limited to a type which is inserted by pushing, it is also possible that the upper edge of the open part 41*a* be given a screw shape, and combined with a screw cap which is engaged by screwing.

The material of the shell member 41 and the bottom member 42 which form the metal vessel 40 is not particularly limited, but can be appropriately chosen from stainless steel, carbon steel, clad steel, titanium, Ni alloys, etc.

This metal vessel 40 has a good appearance and is suitable as a vessel for drinks because the welded part 43 between the bottom member 42 and the shell member 41 is on the lower part of the contour of the bottom member 42. In addition, the bottom member 42 projects into the vessel, and thus the strength of the bottom member 42 is increased, and even if a solid object such as ice is dropped into the opening side, it is difficult to produce deformations and concavities, etc. In addition, because the shell member 41 and the bottom member 42 are connected at a roughly 90°, it is difficult for soilage to accumulate on the bottom of the vessel, and because the welded part 43 is on the bottom of the vessel, and has a diameter smaller than the shell diameter of the shell member 41 and about the same diameter as the upper opening, can be easily cleaned with a sponge, etc. In this case, it is preferable that the angle of contact between the shell member 41 and the bottom member 42 be greater than 90°, but even if it is lower than this, it should be within the range of easy cleaning.

In addition, because the welded part 43 between the shell member 41 and bottom member 42 is at the deepest part of the vessel, it sits stably on a flat surface, the strength of the bottom is high, and few inconveniences are produced by denting during use.

In addition, in the metal vessel of the present invention, because the fabrication obtained by the fabrication method using the above-described hydraulic bulge formation, the welded part 43 can be formed into a circle irrespective of the shape of the shell member, and since the welding is easy, it is possible to freely chose the shape of the shell member 41.

Figure 9:
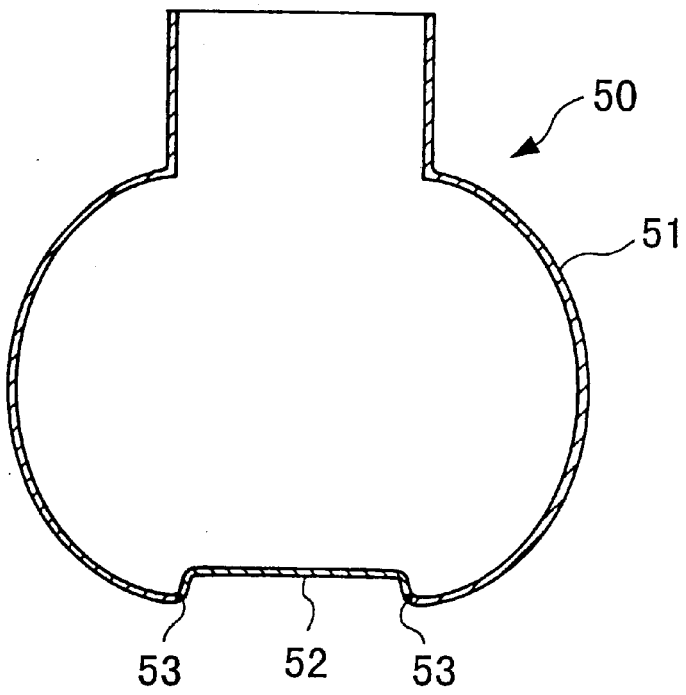
FIG. 9 is a lengthwise cross-section of a first altered shape example of the same metal vessel.

FIG. 9 shows an example showing a metal vessel 50 whose shell member 51 has a spherical cross-section. This metal vessel 50, like the metal vessel 40 is FIG. 8, welds the circular inverted dish shaped bottom member 52 to the bottom part with reduced diameter of the shell member 51 at an approximately 90° angle, and forms a round welded part 53 at the deepest part of the shell member 51.

Figure 10:
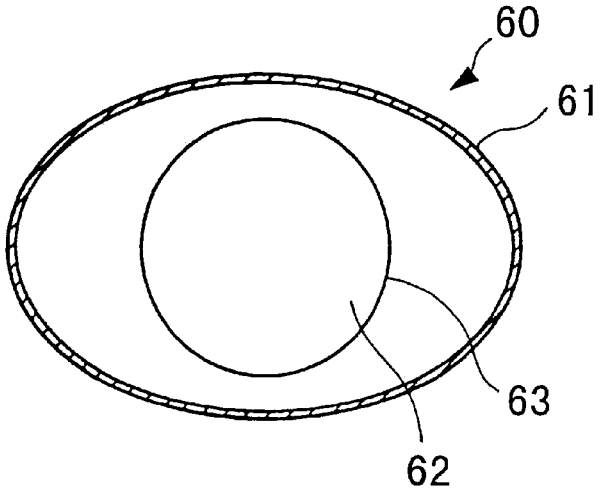
FIG. 10 is a widthwise cross-section of a second altered shape example of the same metal vessel.

In addition, FIG. 10 shows an example of a metal vessel 60 whose shell member 61 has an elliptical widthwise cross-section. This metal vessel 60, like the metal vessel 40 in FIG. 8, welds a circular inverted dish shaped bottom member 62 to the bottom part with reduced diameter part of the shell member 61 at an approximately 90° angle, and the round welded part 63 is formed at the deepest part of the shell member 61.

Figure 11:
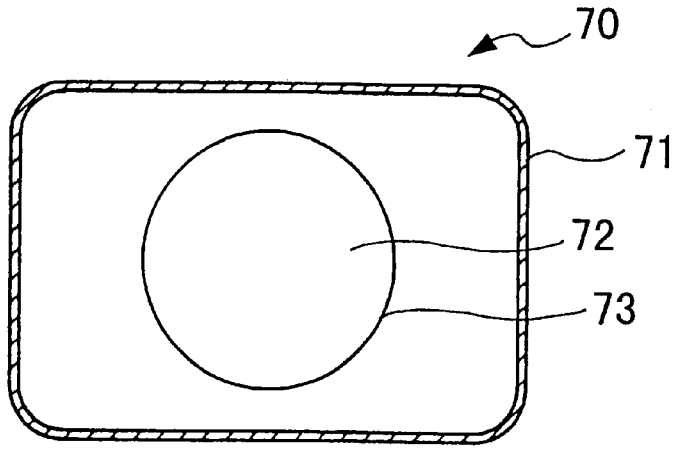
FIG. 11 is a widthwise cross-section of a third altered shape example of the same metal vessel.

In addition, FIG. 11 shows an example of a metal vessel 70 whose shell member 71 has a square widthwise cross-section. This metal vessel 70, like the metal vessel 40 in FIG. 8, welds a circular inverted dish shaped bottom member 72 to the bottom part with reduced diameter part of the shell member 71 at an approximately 90° angle, and the round welded part 73 is formed at the deepest part of the shell member 71.

Figure 12:
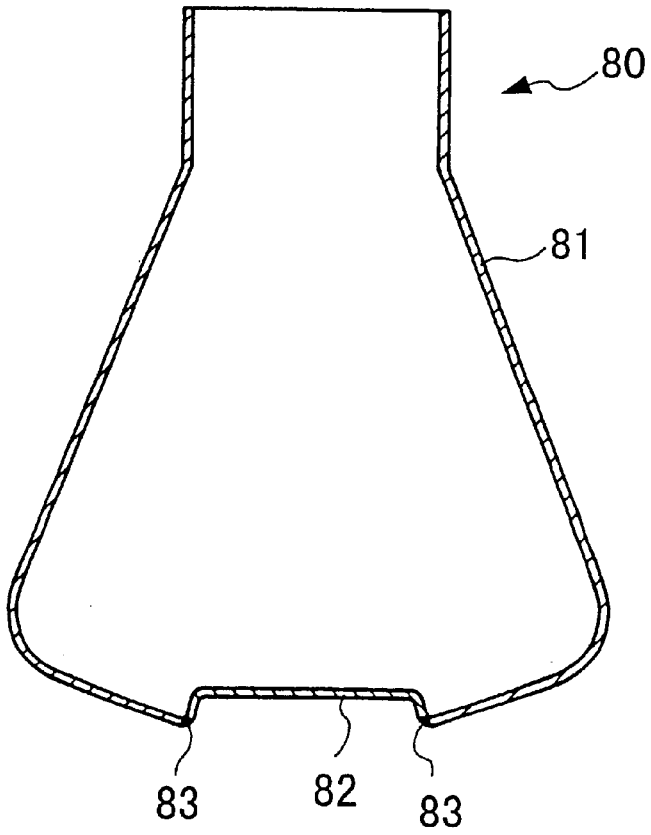
FIG. 12 is a lengthwise cross-section of a fourth altered shape example of the same metal vessel.

Furthermore, FIG. 12 shows an example of a metal vessel 80 whose shell member 81 has a flask shape. This metal vessel 80, like the metal vessel 40 in FIG. 8, welds a circular inverted dish shaped bottom member 82 to the bottom part with reduced diameter part of the shell member 81 at an approximately 90° angle, and the round welded part 83 is formed at the deepest part of the shell member 81.

The metal vessels 50, 60, 70, and 80 shown in these FIGS. 9 to 12 obtain the same superior effects as the metal vessel 40 shown in FIG. 8.

Figure 13:
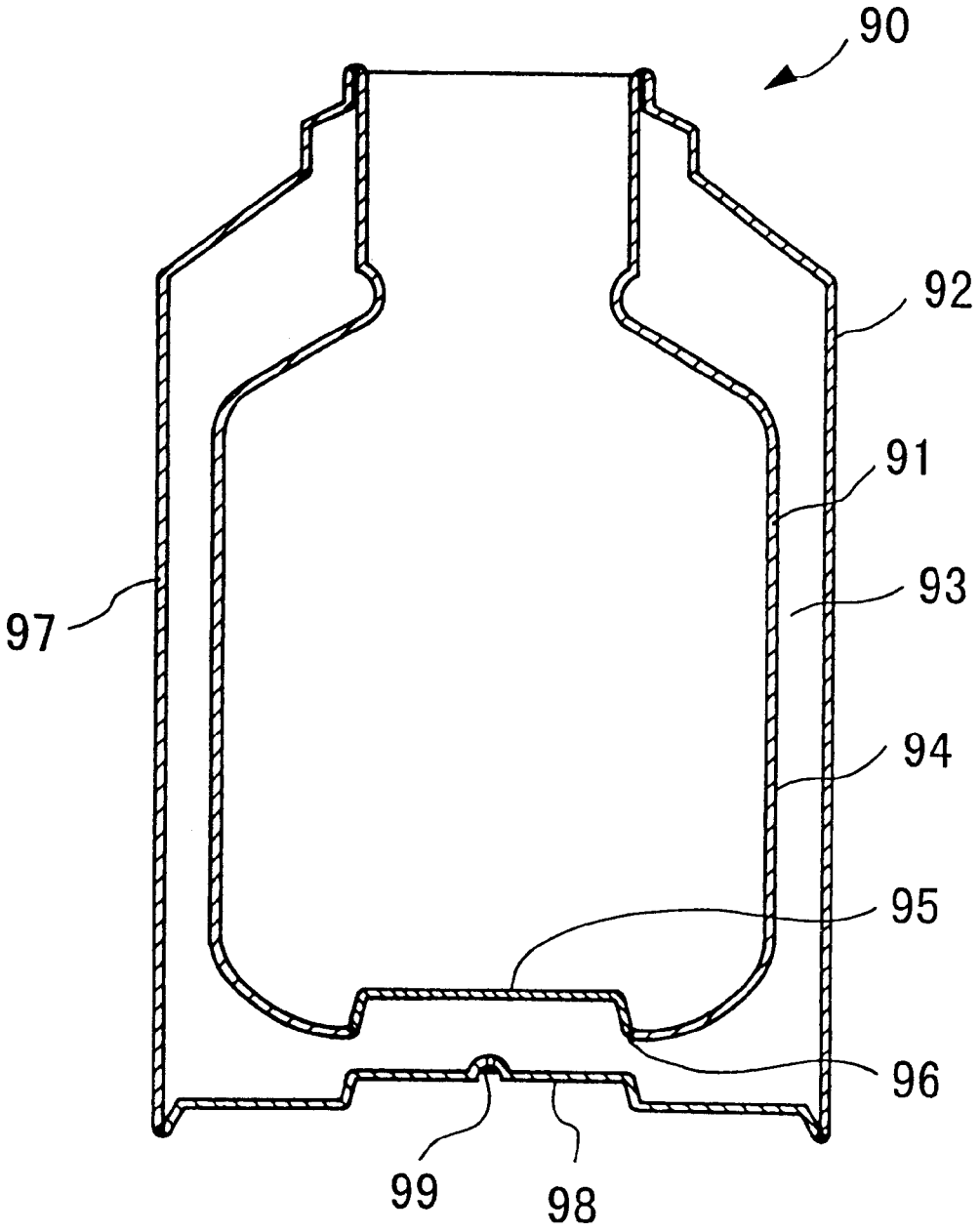
FIG. 13 is a lengthwise cross-section showing another shape of the metal vessel of the present invention.

FIG. 13 shows another embodiment of the metal vessel of the present invention, and in this embodiment, an example is shown wherein the metal vessel according to the present invention is used as the inner vessel 91 of a double walled insulating vacuum vessel 90 used, for example, as a thermos bottle.

This double walled insulating vacuum vessel 90 contains an inner vessel 91 in an outer vessel 92, their respective openings are aligned and made integral by welding, and at the same time, the gap between the inner and outer vessel 91, 92 is vacuum sealed, and the insulating vacuum layer 93 is formed.

The vessel 91, like the metal vessel 40 shown in FIG. 8, welds an inverted dish shaped bottom member 95 to the reduced diameter bottom part of the shell member 94 at a contact angle of approximately 90°, and the round welded part 96 is formed at the deepest part of the shell member.

In addition, the outer vessel 92 comprises a cylindrical shell member 97 whose opening has a reduced diameter in the shape of a flask and a circular bottom member 98 welded to its lower edge. The center part of the bottom member 98 protrudes upward (the insulating vacuum layer 93 side), and roughly at its center, a sealing part 99 is formed. This sealing part 99 has a structure wherein an exhaust hole bored into the center of the concave part hollowed into a hemisphere is sealed by being closed with solder or a glass with a low melting point.

The inner vessel 91 of the double walled insulating vacuum vessel 90 obtains the same effects as the metal vessel 40 shown in FIG. 8, and in particular, in addition the appearance is good because the welded part 96 between the shell member 94 and the bottom member 95 is not noticeable, and the strength of the bottom member 95 is increased, so even if a solid object like ice drops in from the opening, it is difficult to produce deformations and concavities, etc., and soilage does not accumulate easily at the vessel bottom, and it is easy to wash. On these points, it is superior to the conventional inner vessel.

In addition, because the welded part 96 is at the deepest part of the inner vessel, the strength of the bottom is strong, and it sits stably on a flat surface, eaten during the manufacture process, it is easy to handle, there are few defected due to dents, and production efficiency increases.

Moreover, the structure and manufacturing method of the double walled insulating vacuum vessel 90 is not limited to the previous example, and using a brazing metal in a brazing method as a method for engaging the inner vessel 91 and the outer vessel 92 is also possible. In addition, as a method of sealing the vacuum, it is also possible to attach a copper chip tube to the bottom member 98 of the outer vessel, and seal the chip tube by pressure welding after exhausting the vacuum from the gap between the inner and outer vessels via this chip tube.

(Embodiment)

Using a stainless steel plate, a metal vessel according to the embodiment of the present invention shown in FIG. 1 and FIG. 2 was fabricated. As a stainless steel plate, 0.4 mm thick austenitic SUS304 is used.

First, the blank shape of the shell member having a rectangular shape is stamped, rounded by rolling, the edges are engaged by TIG welding, and a 250 mm long cylindrical shell member with an inner diameter of 40 mm having both ends open is made.

Next, in order to fabricate the bottom member, the above stainless steel plate is stamped in a circle, given a dish shape by pressing, making a bottom member with an external diameter of 40 mm by the flange cutting.

The convex side of this bottom member is inserted into one opening facing the inside of the cylinder of the shell member, and engaged by TIG welding to the edge, forming a cylinder with a bottom.

Furthermore, this cylinder with a bottom is mounted in the stationary die of the hydraulic bulge die shown in FIG. 2. On the moving die of the die, a convex part which is aligned the bottom convex shape of the cylinder with a bottom is formed, and disposed so that the welded part between the shell member and the bottom member can be set at the stationary point of the convex part of the moving die. The opening of the cylinder with a bottom is mounted in the stationary die, and while the moving die is moved towards the stationary die, water incorporating rust preventing oil is poured in and pressure applied, and the hydraulic bulge forming is carried out. Subsequently, the pressure is released, the liquid drained, and the metal vessel removed.

Figure 14:
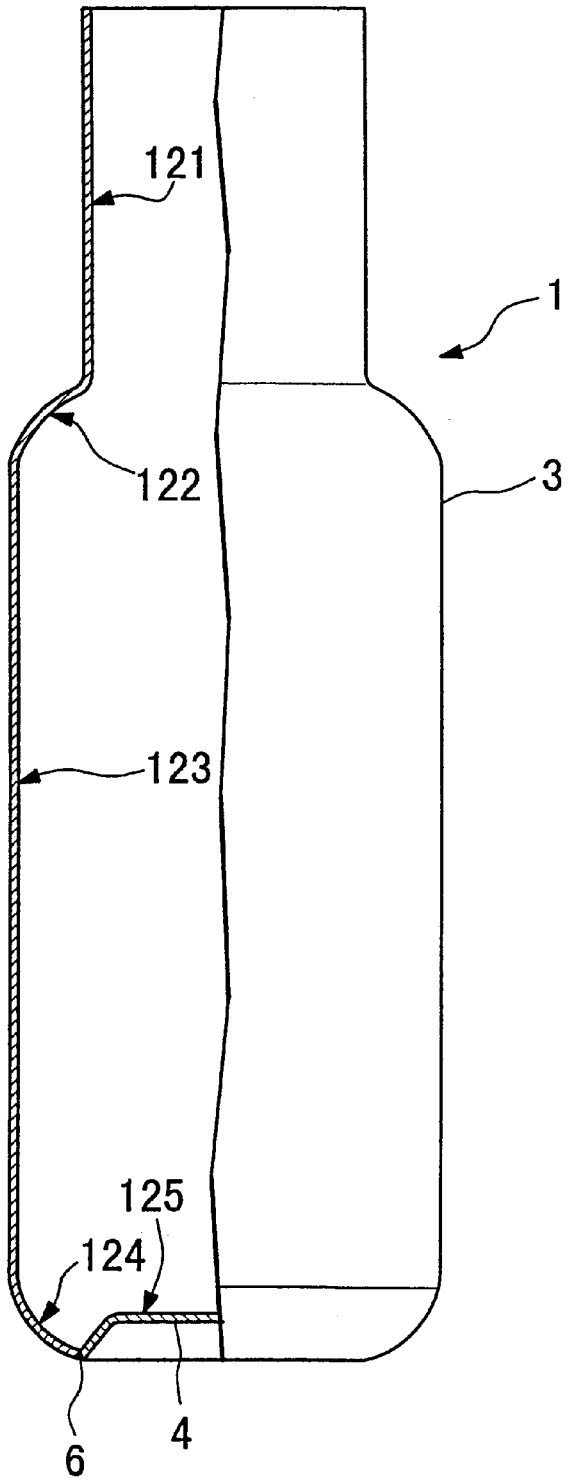
FIG. 14 is a frontal diagram showing a partial cross-sectional view of the metal vessel manufactured according to the embodiment.
Figure 15:
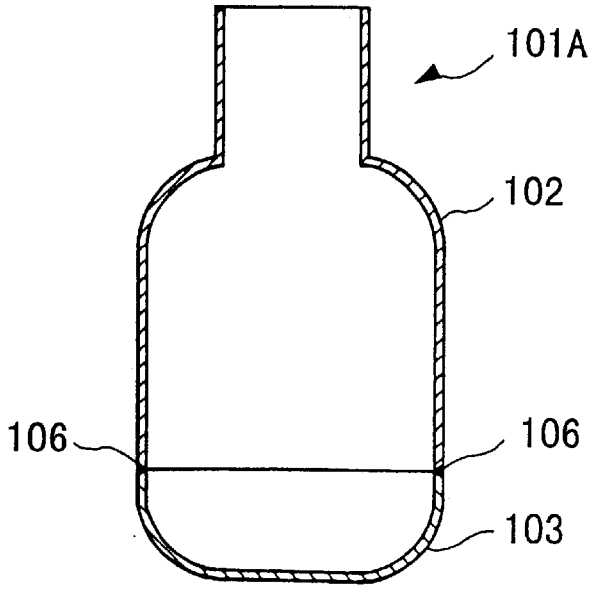
FIG. 15 is a lengthwise cross-section showing a first example of a conventional metal vessel.
Figure 16:
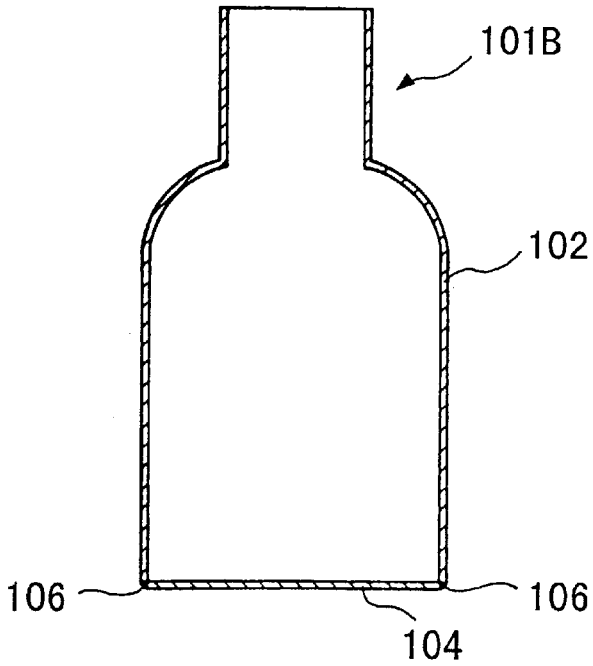
FIG. 16 is a lengthwise cross-section showing a second example of a conventional metal vessel.
Figure 17:
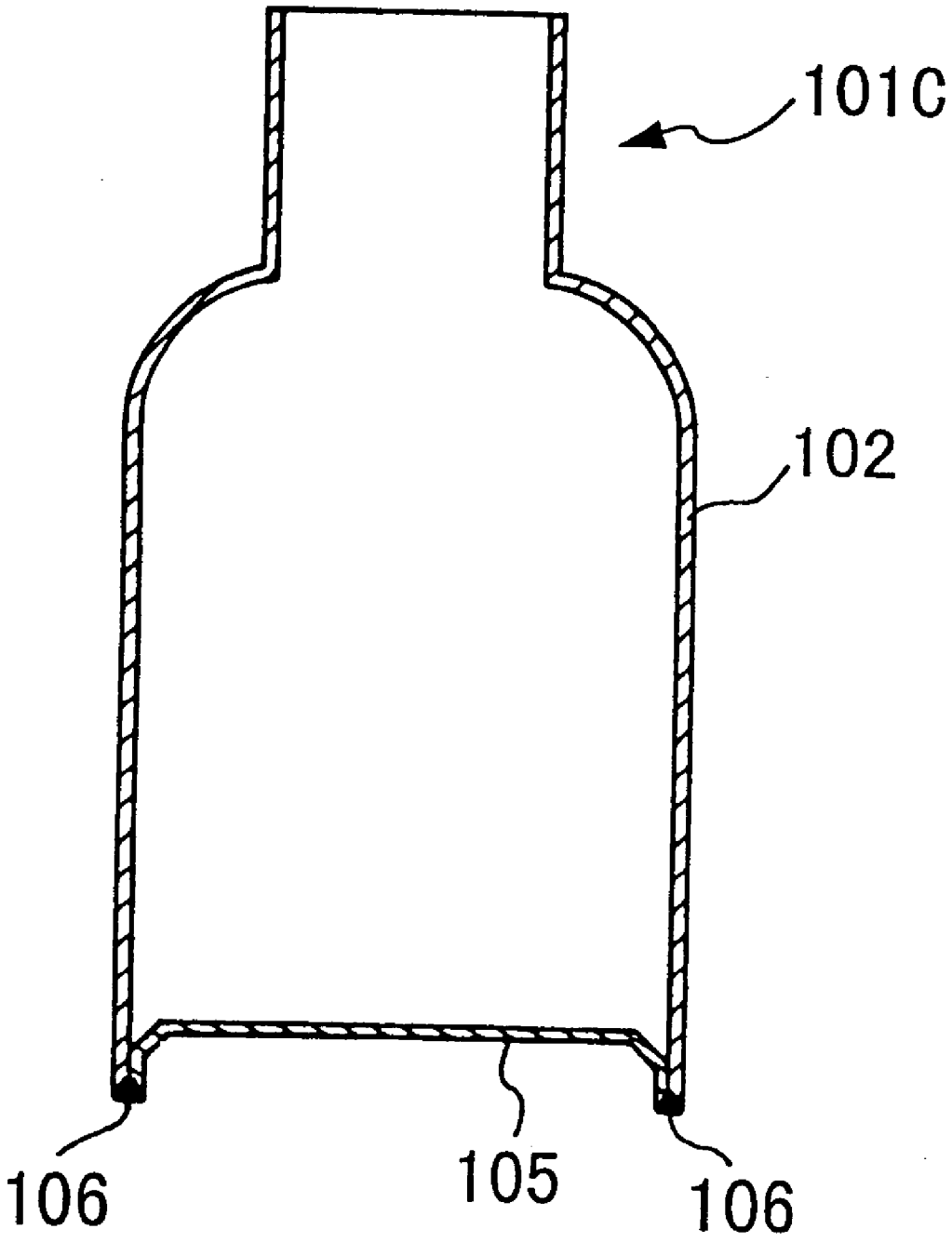
FIG. 17 is a lengthwise cross-section showing a third example of a conventional metal vessel.

After this hydraulic bulge forming, the upper part of the cylinder is cut, producing the metal vessel 1 shown in FIG. 14. The inner volume of the produced metal vessel 1 is 470 ml.

The shell member diameter after formation is 60 mm, the diameter of the welded part is 46 mm, and the diameter of the welded part before the bulge formation has increased about 15% afterwards, but it was possible to produce without the application of excessive force which would produce fractures, etc., in the welded part. In addition, in the present embodiment, it is understood that expansion occurred with the raised part of the bottom surface of the bottom member and the bending point as the stationary point. In addition, the thickness of the bottom member was unchanged from 0.4 mm, but the thickness of the expanding part of the shell member had decreased to about 0.3 mm, and become thinner than the opening.

This metal vessel was removed, and the thickness of each part after the hydraulic bulge processing was measured. The measured positions are each shown by reference numerals 121~125 in FIG. 14. The thickness of each part was described as follows:

| position | thickness (mm) |
|---|---|
| 121 | 0.4 |
| 122 | 0.35 |
| 123 | 0.3 |
| 124 | 0.3 |
| 125 | 0.4 |

From these results, it is clear that there is no local thinning of the of the thickness of the vessel, and as a whole the expansion was uniform.

In addition, the surface roughness of the external surface of the shell part (position of the external surface shown by reference numeral 123) was, as a result of measurements, found to be about 0.2 $\mu$m, and was extremely smooth.

The metal vessel manufactured by the above-described method, in the die of the hydraulic bulge process in the fabrication step of the shell part, because the welded part between the bottom member and the shell member was made the uppermost edge of the die, and the expansion part of the shell part was provided with the uppermost edge as the stationary point, it was possible to push up a small taper shaped hollow in the welded part between the bottom member and the shell member. Because of this, the shell member had a reduced diameter at the lower part, and was engaged with the bottom member at an angle, and thus, even when soilage was present, it was easy to remove, and in addition, even when cleaning, because there was not a narrow gap, it was easy to clean.

In addition, the appearance was good because the welded part between the bottom member and the shell member was at the lower end of the contour of the bottom member, and because the bottom member protruded into the vessel, the strength of the bottom member was increased, and even if a solid object like ice was dropped in, it was difficult to produce deformations and concavities.

In addition, the vessel could sit stably on a flat surface because the welded part between the shell member and the bottom member was at the deepest part of the vessel, and thus, because the strength of the bottom part was increased, it was easy to handle even in production processes, not just in use, and few defected were produced due to dents. In addition, because the welded part had a smaller diameter than the diameter of the shell part, it was easy to clean with a sponge.

In addition, the inner vessel and the outer vessel were made integral with a gap therebetween, and the present fabrication method could be applied when producing the inner vessel of the double walled insulating vacuum metal vessel having a vacuum between the inner and outer vessel, and it was possible to fabricate an excellent double walled vacuum vessel.

Generally, because austenitic stainless steel has good formability and corrosion resistance, it is used as a material for metal vessels having various uses. However, because conventional formation is carried out locally, depending on the conditions of production point, the small irregularities in the surface of the stainless steel are produced. As a result, this influences the plating applied as a radiation measure on the double layer vacuum insulation metal vessel, and there are times when a uniform plating cannot be formed. However, the metal vessel obtained by the method of the present invention had an extremely smooth external surface. In addition, when trying to apply plating to the external surface when using it as the inner vessel of a double walled vacuum vessel, this metal vessel had a very fine surface roughness, and because the smoothness is average for the material, the adhesion of the plating was good. Because of this, it was possible to set the conditions (control of the concentration in the plating tank, current density, etc.) in the plating process easily, and it was possible to obtain easily a good plating, and thus a double walled insulating vacuum vessel with superior heat retention characteristics could be obtained.

What is claimed is:

1. A metal vessel comprising:

a cylinder including a shell member and a bottom member, the shell member comprises:

a shell part adjacent to the bottom member, the shell part having an external diameter which is larger than the external diameter of the bottom member; and a neck part at an end opposite to the bottom member, the neck part having an external diameter which is smaller than the external diameter of the shell part, the neck part projecting from the shell part and is formed from the same member as the shell part; and the neck part including an opening part;

wherein one end of the shell member being made integral to the bottom member by welding, the other end of the shell member providing the opening part wherein the cylinder is formed by a fabrication method comprising the steps of:

disposing the cylinder in a die comprising a moving die and a stationary die in a state wherein the moving die and the stationary die are separated, so that the opening part is on the stationary die side and the bottom member is on the moving die side; and fabricating the metal vessel by carrying out hydraulic bulge formation in such a manner that a length of the weld between the shell member and the bottom member is approximately the same before and after the hydraulic bulge formation by moving the moving die towards the stationary die, expanding the shell member of the cylinder, and at the same time injecting a liquid into the cylinder and then applying pressure.

2. The metal vessel according to claim 1, wherein the shell member has an external diameter larger than an external diameter of the opening part and bottom member.

3. The metal vessel according to claim 1, wherein the shell member is a non-circular tube.

4. The metal vessel according to claim 1, wherein the bottom member is dish shaped.

5. The metal vessel according to claim 4, wherein the bottom member is welded to the shell member so that a concave face of the bottom member faces outside of the shell member.

6. The metal vessel according to claim 4, wherein the bottom member is welded to the shell member so that a concave face of the bottom member faces inside of the shell member.

7. The metal vessel according to claim 4, wherein the bottom member is welded to the shell member with a concave face of the dish shaped bottom member facing outward.

8. The metal vessel according to claim 4, wherein the bottom member is welded to the shell member with a concave face of the dish shaped bottom member facing inward.

9. The metal vessel according to claim 1, wherein the bottom member is a flat plate.

10. The metal vessel according to claim 1, wherein the bottom member is round.

11. The metal vessel according to claim 1, wherein the bottom and shell members have external diameters, such that the external diameter of the bottom member is smaller than the external diameter of the shell member of the vessel.

12. The metal vessel according to claim 1, further comprising a shell member whose external shell diameter is larger than a diameter of the opening part and a diameter of the bottom member, and wherein the shell member has an inwardly directed flange at one end to provide a reduced diameter opening in the shell member, the bottom member being welded to the flange to close the opening and the weld between the bottom member and the shell member is positioned at a deepest part of the vessel with respect to the opening part.

13. The metal vessel according to claim 12, wherein the bottom member is round.

14. The metal vessel according to claim 1, wherein the shell member has an outer surface and a surface roughness of the outer surface of the shell member is about 1.0 $\mu$m, or less.

15. A double-walled vacuum metal vessel, wherein an inner vessel is a metal vessel according to claim 1.

16. The metal vessel according to claim 1, wherein the opening part forms an opening of the metal vessel and is formed from the same member as the shell part.

17. A metal vessel comprising:

a cylinder including a shell member and a bottom member, the shell member comprises:

a shell part; and a neck part at an end opposite to the bottom member, the neck part having an external diameter which is smaller than the external diameter of the shell part, the neck part projecting from the shell part and is formed from the same member as the shell part, and the neck part having an opening part;

wherein the shell member has an inwardly directed flange at one end to provide a reduced diameter opening in the shell member, the bottom member being welded to the flange to close the opening reduced diameter and the weld between the bottom member and the shell member is positioned at a deepest part of the vessel with respect to the opening part.

18. The metal vessel according to claim 17, wherein the bottom member is round.

19. A double-walled vacuum metal vessel, wherein an inner vessel is a metal vessel according to claim 17.

20. The metal vessel according to claim 17, wherein the opening part forms an opening of the metal vessel and is formed from the same member as the shell part.

* * * * *